United States Patent [19]

Swanson

[11] 4,213,609

[45] Jul. 22, 1980

[54] GRIP BUMPER

[76] Inventor: Arthur P. Swanson, 1454 Estate La., Glenview, Ill. 60025

[21] Appl. No.: 31,189

[22] Filed: Apr. 18, 1979

[51] Int. Cl.[2] ..... A63B 5/20

[52] U.S. Cl. ..... 273/75

[58] Field of Search ..... 273/75, 81 R, 81 B, 273/73 J, 76, 29 R, 67 R

[56] References Cited

U.S. PATENT DOCUMENTS

| | | | |
|---|---|---|---|
| 1,979,460 | 11/1934 | Forsberg | 273/75 X |
| 2,205,769 | 6/1940 | Sweetland | 273/75 X |

FOREIGN PATENT DOCUMENTS

| | | | |
|---|---|---|---|
| 2213499 | 9/1972 | Fed. Rep. of Germany | 273/75 |
| 8809 | of 1898 | United Kingdom | 273/75 |

*Primary Examiner*—John D. Yasko

*Attorney, Agent, or Firm*—Hill, Van Santen, Steadman, Chiara & Simpson

[57] ABSTRACT

An attachment for the handles of rackets or paddles used for tennis, paddleball, and the like sports and games provides an abutment enabling the user to exert pressure and power to eliminate slippage and deliver more power to the ball or the like struck by the racket or paddle. The abutment is preferably part of the grip portion of the handle of a racket or paddle in the form of an outturned concave peripheral rib at the inner end of the grip to be engaged by portions of the hand of the user in a manner which does not confine or alter the user's grip but receives thrust from the user to deliver extra power and eliminate slippage. The rib is an extension of the faces of the grip and is preferably the base of a flat faced cone converging to the paddle or racket handle. The forefinger of the user's hand fits comfortably against the rib preventing the hand from slipping up on the handle and also exerting driving force from this forefinger to the racket or paddle. The tip end of the thumb may also be pressed against the rib and since the rib provides added thickness to the handle the thumb and forefinger will not be pinched together thereby minimizing rotation of the handle to keep the racket head square at impact. The device does not interfere with rotating or spinning of the racket or paddle between strokes and since the rib circumscribes the grip it will function in the same manner when using either striking face of the racket or paddle. The device is somewhat resilient to absorb vibration and shock.

7 Claims, 6 Drawing Figures

GRIP BUMPER

FIELD OF THE INVENTION

This invention relates to the art of hand positioners or grips for the handles or shanks of tools, sporting goods equipment and the like and particularly deals with a bumper grip or positioner for the handles of rackets, paddles and the like striking devices to deliver more power without interfering with a conventional or comfortable engagement of the hand and fingers of the user on the handle.

BACKGROUND OF THE INVENTION

Heretofore known grips or hand positioning devices for tools, golf clubs, bats, tennis rackets and the like interfered with conventional or comfortable positioning of the hands of the user on the handles. These devices usually constrained the fingers of the hand in such a manner as to prevent free rotation of the handle and in some instances placed an added strain on the fingers causing discomfort and even pain to the user. These grip attachments were concerned primarily with positioning and restraint of the hand and fingers on the handle and did nothing to increase the striking force delivered from the user to the handle.

It would be an advance in the art to provide an attachment for the handles of tools and sporting goods equipment which would act as a bumper receiving portions of the hand thereagainst without changing the grip desired by the user and yet deliver more of the energy from the user to the handle and thence to the striking face on the handle.

SUMMARY OF THIS INVENTION

According to this invention, a bumper is provided on the grip portion of a handle for a striking device such as a hammer, bat, golf club, racket or paddle to receive thrust from the hand of the user for correctly positioning the hand lengthwise of the grip and transferring striking energy from the user to the handle for delivery to the striking face of the equipment. The bumper does not interfere with the desired hand grip of the user and does not constrain the hands or fingers. The bumper has an outturned concave rib circumscribing the upper or inner end of the grip accommodating rotation of the equipment such as a racket or paddle to present opposite striking faces to the ball.

The bumper of this invention preferably is part of the grip on the handle of the equipment to which it is to be attached in the form of a conical sleeve with a concave base at the inner end of the grip. The outer surface of the conical sleeve is shaped to conform with the grip surfaces on the handle and the base of the cone merges into the grip along gently sloping concave walls.

It is then an object of this invention to provide an attachment or extension for the grip portions of handles of striking devices such as tools, sporting goods equipment, and the like which receives the forefinger of the user snugly thereagainst and is effective to deliver more thrust from the hand of the user to the striking surface.

Another object of the invention is to provide a grip bumper for the grips of tennis rackets, paddles and the like against which the forefinger and thumb of the user is thrust to correctly position the hand and deliver more striking power.

The specific object of the invention is to provide a grip bumper for tennis rackets and the like which has an outturned concave rib against which the forefinger of the user may be thrust and the racket may be rotated between strokes without discomfort to the forefinger.

A specific object of the invention is to provide a grip bumper for tennis rackets which will not interfere with the hand grip of the user but will be effective to deliver more striking force to the head of the racket.

Other and further objects of the invention will be apparent to those skilled in this art from the following detailed description of the annexed sheet of drawings which, by way of a preferred example illustrates one embodiment of the invention.

ON THE DRAWINGS

AS SHOWN ON THE DRAWINGS

Figures 1, 2, 3, 4, 5, 6:
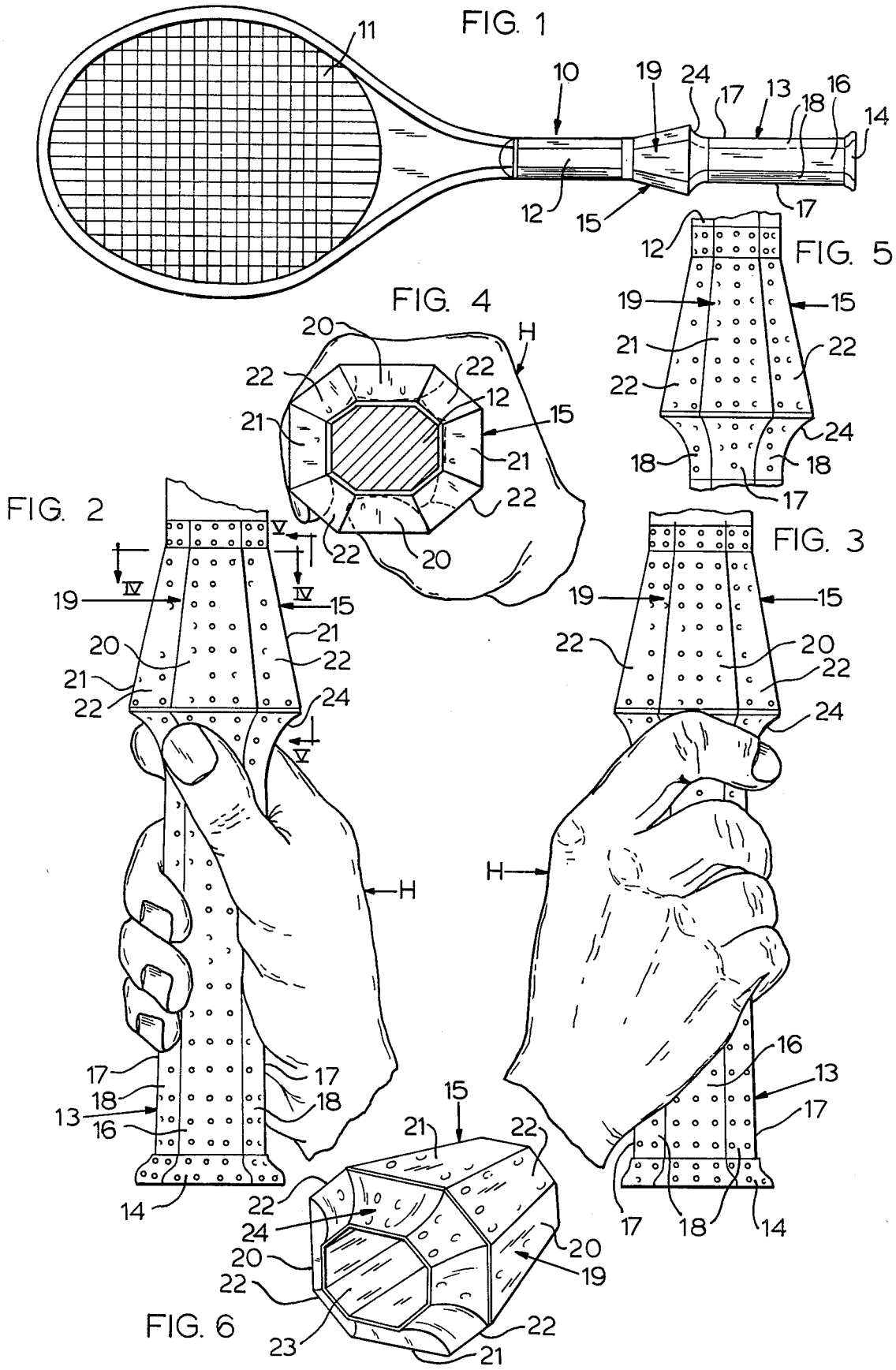
FIG. 1 is a plan view of a tennis racket equipped with the grip bumper of this invention.
FIG. 2 is an enlarged portion of the grip of the tennis racket of FIG. 1 illustrating the manner in which the forefinger and thumb of the hand of a user engages the concave abutment of the bumper.
FIG. 3 is a view similar to FIG. 2 but illustrating the rear portion of the hand of the user on the grip.
FIG. 4 is a cross sectional view along the line IV—IV of FIG. 2.
FIG. 5 is a top view along the line V—V of FIG. 2.
FIG. 6 is a perspective view of the upper or inner end of the grip bumper of this invention.

In FIG. 1 a conventional tennis racket 10 with a head 11, handle 12, grip 13 along the extremity of the handle and butt end 14 on the end of the grip 13 has a grip bumper 15 of this invention at the upper or inner end of the grip portion 13. This bumper 15 can be an integral part of the grip or a separate piece.

As is conventional, the grip portion 13 has relatively wide flat front and rear faces 16, somewhat narrower flat top and bottom faces 17 and four flat beveled corners 18 connecting these faces. This generally octagonal configuration extends from the outwardly flaring butt end 14 for a sufficient distance up the handle 12 to accommodate grasping by the hand H of a user. A variety of placements of the fingers and thumb of the hand H around the grip 13 are accommodated by the general octagonal shape of the grip 13. Most of these grips involve wrapping the forefinger of the hand around a rear face 16 and face 17 of the grip with the thumb overlying the front face 16 thus providing a "pinch"—like engagement of the thumb and forefinger on the grip. The remaining fingers are wrapped around the back face 16 and the bottom face 17 and may extend partially over the front face 16. This positioning of the thumb, forefinger and remaining fingers may be varied to accommodate grips such as are known as "Eastern Forehand", and "Continental Backhand" for serving, volleying and smashing and the "Australian Grip" that can be used for most shots. Tennis players frequently change the grip and even spin the handle between shots to relieve tension. The generalized octagonal shape of the grip portion 13 of the handle readily accommodates these changes.

The grip bumper 15 of this invention in no way interferes with changing of grip styles on the grip portion 13 of the handle nor does it interfere with spinning of the handle. However the grip bumper 15 correctly positions the hand lengthwise of the grip 13 and for this purpose it is preferably an integral part of the grip 13 at its upper or inner end.

The bumper grip 15, as best shown in FIG. 6 has a generally octagonal cone sleeve portion 19 with the relatively wide front and rear flat sides 20, the relatively wide top and bottom sides 21, and the four narrower tapered corners 22 joining these walls. The hollow interior 23 of the sleeve is sized to snugly fit the handle 12.

The cone-like sleeve 19 with its flat faces has a concave base providing an outturned rib 24 circumscribing the inner or upper end of the grip 13 to receive the forefinger and thumb of a user comfortably against its gently sloping concave walls. The convex curves of the sidewalls of the rib 24 are such as to accommodate thrusting of the leading side of the forefinger of the hand H thereagainst without confining the finger as illustrated in FIGS. 2–4.

As also shown in FIGS. 2–4 the top of the thumb of the hand H overlies and thrusts against the rib 24. The increased thickness or rear to front distance provided by wrapping the forefinger in the concave rib 24 prevents the leading end of the forefinger from underlapping the thumb to eliminate heretofore encountered "pinching" of the thumb and forefinger with attendant loss of thrust.

While the conical sleeve end 19 is preferably part of the grip 13 it can be a separate part as shown in FIG. 6.

From the above descriptions it will therefore be understood that the grip bumper of this invention positions the hand of the user consistently in correct positions along the length of the grip of the handle and in addition provides an abutment surface snugly receiving the forefinger so as to transfer additional striking thrust from the hand of the user to the racket.

While the grip bumper of this invention has been illustrated only in connection with a tennis racket it should be understood that it can be made integral with or applied on the grip portions of any type of striking device including especially rackets or paddles used for tennis, paddleball, squash, platform tennis, badminton, table tennis and racquetball.

I claim as my invention:

1. A grip bumper for the handles of striking devices which comprises a grip sized for fitting around the handle of such a device having a continuous outturned peripheral rib converging continuously without any protuberance to the grip for receiving thereagainst portions of the hand of the user without restraining against rotation of the device in the hand to deliver additional striking thrust from the hand to the device.

2. A grip bumper for the grips of rackets, paddles and the like sporting equipment which comprises a sleeve portion having a concave outturned rib with flat faces circumscribing the inner end of the grip providing an abutment adapted to receive thereagainst the forefinger of the hand of a user.

3. A grip bumper for the handles of striking devices which comprises a grip sized for fitting around the handle of such a device having an outturned peripheral rib receiving thereagainst portions of the hand of the user to deliver additional striking thrust from the hand to the device, and said grip including a polygonal sleeve portion with said outturned rib having conforming polygonal sides.

4. The grip bumper of claim 1 including a sleeve snugly fitting the handle of the device and with the outturned rib having concave outturned flat sidewalls adapted to receive the forefinger of the hand of a user snugly thereagainst.

5. The grip bumper of claim 2 wherein the sleeve and rib have flat front and back faces, flat top and bottom faces, and tapered corners.

6. A grip bumper for the handle grips of rackets, paddles and the like sporting equipment having handles which comprises a sleeve portion having a concave outturned rib circumscribing the inner end of the grip providing an abutment adapted to receive thereagainst the forefinger of the hand of a user and positioned at the base of a cone converging to the handle of the sporting equipment.

7. The grip bumper of claim 2 wherein the concave outturned rib with the flat faces projects to a height substantially equivalent to the thickness of the forefinger of a user.

* * * * *